US006029829A

United States Patent [19]

Ovadia

[11] Patent Number: 6,029,829

[45] Date of Patent: Feb. 29, 2000

[54] RING PAD FOR A JEWELRY TRAY

[76] Inventor: Joseph Ovadia, 109 Long Hill Rd., Little Falls, N.J. 07424

[21] Appl. No.: 09/241,988

[22] Filed: Feb. 2, 1999

[51] Int. Cl.[7] ..... A47F 7/00; B65D 6/04

[52] U.S. Cl. ..... 211/85.2; 206/6.1; 206/566

[58] Field of Search ..... 211/85.2, 89.01, 211/6; 206/6.1, 562, 564, 566

[56] References Cited

U.S. PATENT DOCUMENTS

| | | | |
|---|---|---|---|
| 2,119,832 | 6/1938 | Schless . | |
| 2,358,295 | 9/1944 | Baciqalupi . | |
| 3,228,518 | 1/1966 | Coby . | |
| 4,432,456 | 2/1984 | Ovadia et al. | 206/566 |
| 4,685,568 | 8/1987 | Elsfelder | 206/566 X |
| 4,917,235 | 4/1990 | Feiler | 206/6.1 |
| 5,826,711 | 10/1998 | Ovadia | 206/6.1 |
| 5,855,345 | 1/1999 | DiMaggio | 206/6.1 X |

*Primary Examiner*—Robert W. Gibson, Jr.
*Attorney, Agent, or Firm*—Richard M. Goldberg

[57] ABSTRACT

A ring pad includes a top wall made from an elastic and resilient material; a side wall for supporting the top wall above a surface; an X-shaped slot in the top wall, the X-shaped slot having intersecting leg portions that meet at a center, the X-shaped slot being shaped to define first and second opposing hold-down flaps in the top wall on opposite sides of the slot and which form an obtuse angle at the center, and adjacent first and second retainer flaps in the top wall on further opposite sides of the slot and which form an acute angle at the center, such that a ring can be releasably captured between the hold-down flaps and the retainer flaps, with the hold-down flaps positioned within the ring and the retainer flaps positioned outside of the ring; a reinforcing wall at an underside of each retainer flap for increasing a spring action thereof; and a lower support wall connected with an underside of the top wall and in surrounding relation to the slot.

16 Claims, 7 Drawing Sheets

RING PAD FOR A JEWELRY TRAY

BACKGROUND OF THE INVENTION

The present invention relates generally to display devices, and more particularly, is directed to a ring pad for a jewelry tray for holding and displaying rings thereon.

One known type of ring tray includes a plurality of projections or posts extending from a board and on which the rings are situated. However, such ring trays are complicated in structure and manufacture. An example of such a ring tray is disclosed in U.S. Pat. No. 5,649,625 to Ovadia.

As an alternative to the above, other ring trays are known in which a thin fabric sheet is provided in a rigid plastic ring tray, and a foam pad is positioned beneath the thin fabric sheet for holding the rings. The thin fabric sheet is adhered to the peripheral ledge of the jewelry tray, and to the upper surface of the foam pad. After the thin fabric sheet is adhered to the foam pad, a plurality of slits are die cut therein. This results in the foam pad being likewise die cut and thereby aligned with the slits in the thin fabric sheet. In this manner, a ring can be pushed through a slit in the thin fabric sheet and held by the foam pad. An upper fabric pad having a plurality of openings is adhered to the upper surface of the thin fabric sheet, with the openings in alignment with the slits. However, since the above ring trays are made from a plurality of different elements and layers, the cost and complexity of manufacturing the same is great.

Lastly, clips are known for holding rings on a jewelry pad. However, the clips are separate elements from the jewelry pad, and therefore, require an additional element, with more complexity.

Further, it is a desire to show the entire ring on a jewelry pad, without the price tag normally attached to the ring, showing. With the foam pads, the tag must be inserted into the slits in the foam. However, this becomes cumbersome. With the clips, the tags are always showing. With the posts, this requires that the posts be open at the back, and is also cumbersome.

OBJECTS AND SUMMARY OF THE INVENTION

Accordingly, it is an object of the present invention to provide a ring pad that overcomes the problems with the aforementioned prior art.

It is another object of the present invention to provide a ring pad which does not require additional elements extending above the upper surface of the ring pad.

It is still another object of the present invention to provide a ring pad that does not require a plurality of different layers of different materials.

It is yet another object of the present invention to provide a ring pad in which the rings are positively held to the ring pad by spring flaps.

It is a further object of the present invention to provide a ring pad in which the rings cannot inadvertently escape therefrom.

It is a still further object of the present invention to provide a ring pad in which the tags attached to the rings can easily be hidden below the ring pad.

It is a yet further object of the present invention to provide a ring pad that is lightweight and durable, and easy and economical to manufacture and use.

In accordance with an aspect of the present invention, a ring pad includes a top wall made from an elastic and resilient material; and a slot in the top wall, the slot being shaped to define a first hold-down flap in the top wall on one side of the slot and an adjacent first retainer flap in the top wall on an opposite side of the slot, such that a ring can be releasably captured between the hold-down flap and the retainer flap, with the hold-down flap positioned within the ring and the retainer flap positioned outside of the ring.

Preferably, there is a side wall for supporting the top wall above a surface, and a lower support wall connected with an underside of the top wall and in surrounding relation to the slot.

The slot includes an elongated slot portion having opposite ends, and a transverse slot portion extending at an angle from at least one side of the elongated slot portion at a position between the opposite ends of the elongated slot portion. In one embodiment, the angle is an acute angle, and in another embodiment, the angle is a right angle.

In accordance with another embodiment of the present invention, a ring pad includes a top wall made from an elastic and resilient material; and a slot in the top wall, the slot being shaped to define first and second opposing hold-down flaps in the top wall on opposite sides of the slot and adjacent first and second retainer flaps in the top wall on further opposite sides of the slot, such that a ring can be releasably captured between the hold-down flaps and the retainer flaps, with the hold-down flaps positioned within the ring and the retainer flaps positioned outside of the ring.

In one embodiment, the slot has a shape of an X. In such case, the X-shaped slot has intersecting leg portions that meet at a center, and the hold-down flaps form an obtuse angle at the center and the retainer flaps form an acute angle at the center. Also, a reinforcing wall is provided at an underside of each retainer flap for increasing a spring action thereof.

In another embodiment, the slot includes a linear elongated slot portion and two spaced apart transverse slot portions which intersect the elongated slot portion. Preferably, the transverse slot portions intersect the elongated slot portion at right angles, and the elongated slot portion substantially bisects the transverse slot portions. Specifically, the hold-down flaps are defined between the elongated slot portion and the transverse slot portions, and on opposite sides of the elongated slot portion, and the retainer flaps are formed to the outside of the transverse slot portions.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
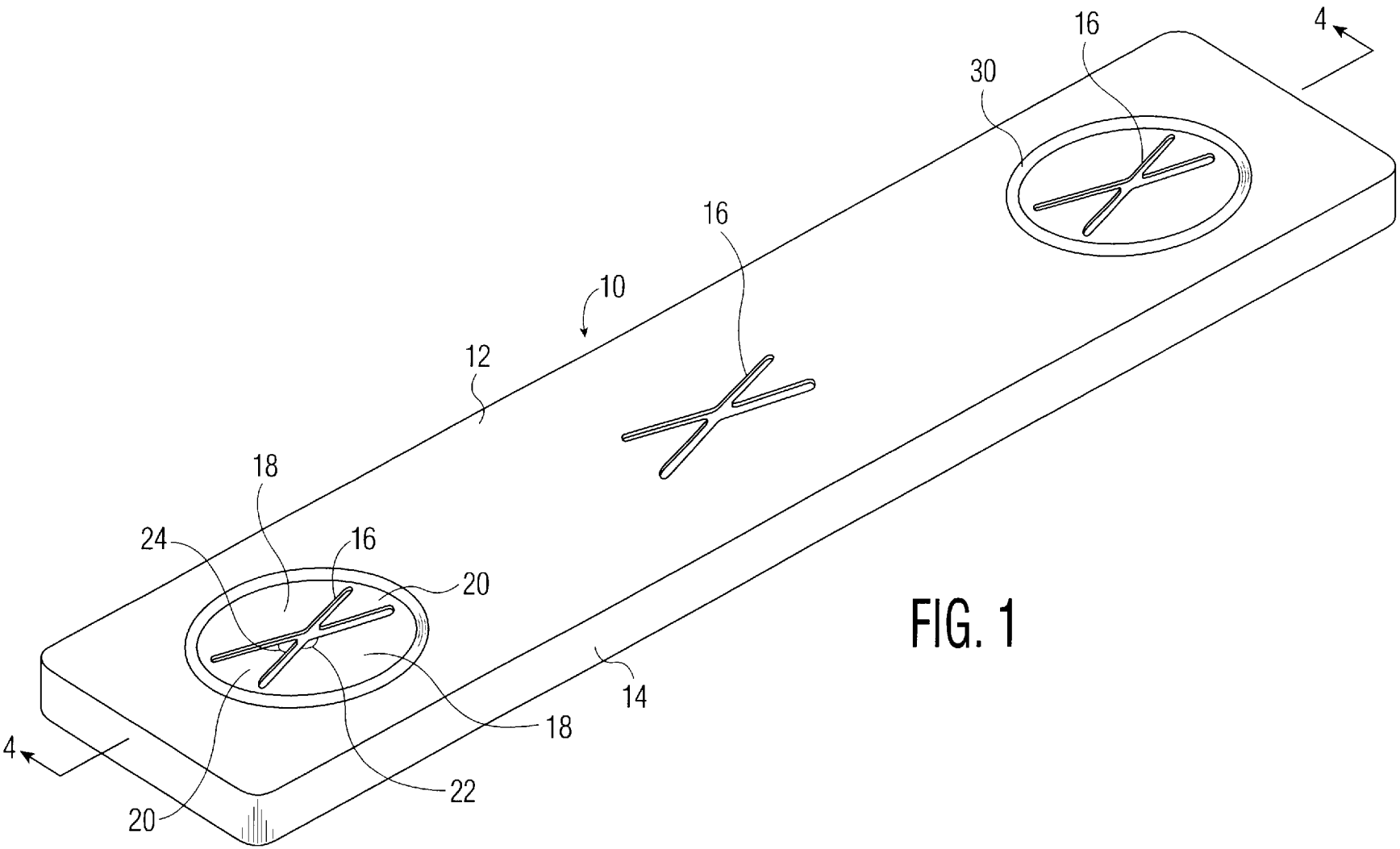
FIG. 1 is a top perspective view of a ring pad according to a first embodiment of the present invention.

Referring to the drawings in detail, and initially to FIGS. 1–6 thereof, a ring pad 10 according to a first embodiment of the present invention includes a rectangular top wall 12 and a peripheral side wall 14 connected at the periphery of top wall 12 and extending down therefrom. The lower edge of side wall 14 is used for supporting jewelry pad on a surface or in a jewelry tray (not shown), as is well-known, for example, from U.S. Pat. No. 4,432,456.

Preferably, each pad 10 is made from a flexible and resilient plastic material that can be deformed but which retains its shape when the deformation force is removed. Alternatively, pad 10 can be made of a rubber or any other suitable material. In any event, pad 10 is made of a high memory material with a substantially thin, constant thickness throughout. Because pad 10 has a substantially constant thickness throughout, it is thin and therefore easily deformable, while reducing the amount of material that is used.

Thus, each pad 10 is formed as a single, unitary plastic molded part, although it is also possible to provide a fabric material or flocked layer thereon.

In accordance with the present invention, jewelry pad 10 is formed with at least one cut or slot 16 in the shape of an X, although any other suitable shape can be used. Further, although three X-shaped slots 16 are shown, the present invention is not limited to this number.

As a result, each X-shaped slot 16 forms two opposing triangular hold-down flaps 18 and two opposing triangular spring or retainer flaps 20. Preferably, the apex angle 22 of hold-down flaps 18 at the center of the X-shaped slot 16 is an obtuse angle, while the apex angle 24 of spring flaps 20 at the center of the X-shaped slot 16 is an acute angle. However, apex angles 22 and 24 can also be right angles.

Further, a reinforcing wall 26 is formed on the underside of each spring flap 20 and extends outwardly substantially from the apex of each spring flap 20 which is adjacent to the center of the X-shaped slot 16, in a bisecting manner. Reinforcing wall 26 increases the spring pressure of spring flap 20, as will be understood from the description hereinafter.

Figure 2:
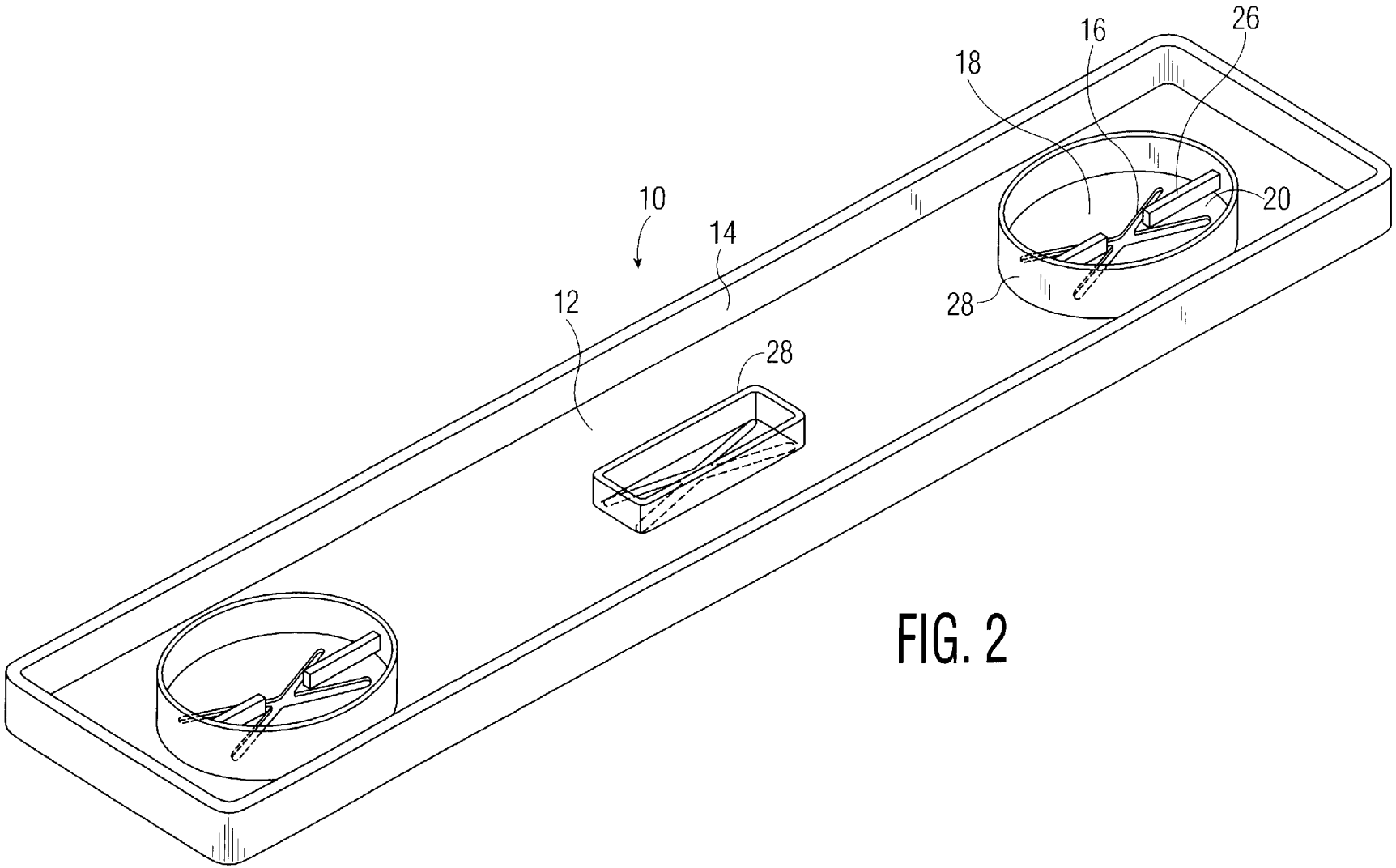
FIG. 2 is a bottom perspective view of the ring pad of FIG. 1.
Figure 3:
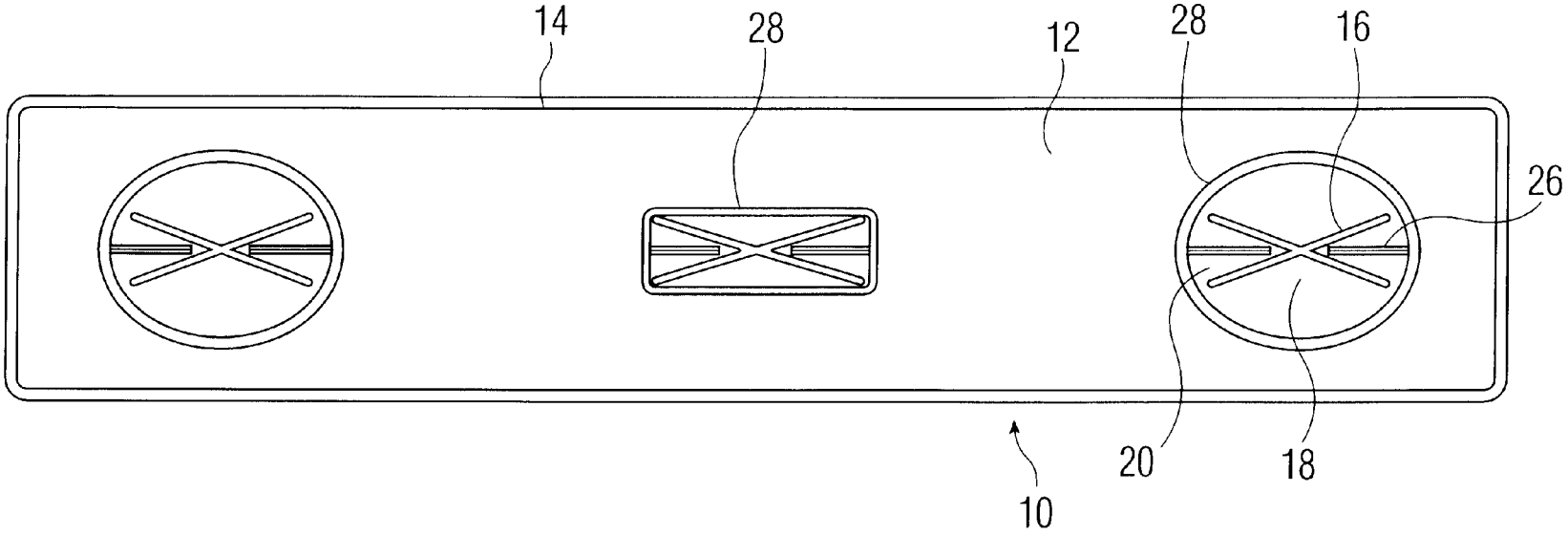
FIG. 3 is a bottom plan view of the ring tray of FIG. 1.
Figure 4:
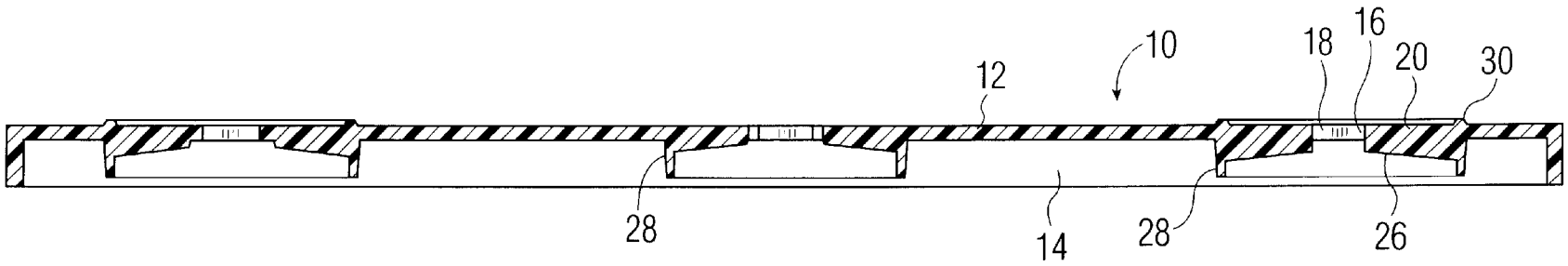
FIG. 4 is a cross-sectional view of the ring tray of FIG. 1, taken along line 4—4 thereof.
Figure 5:
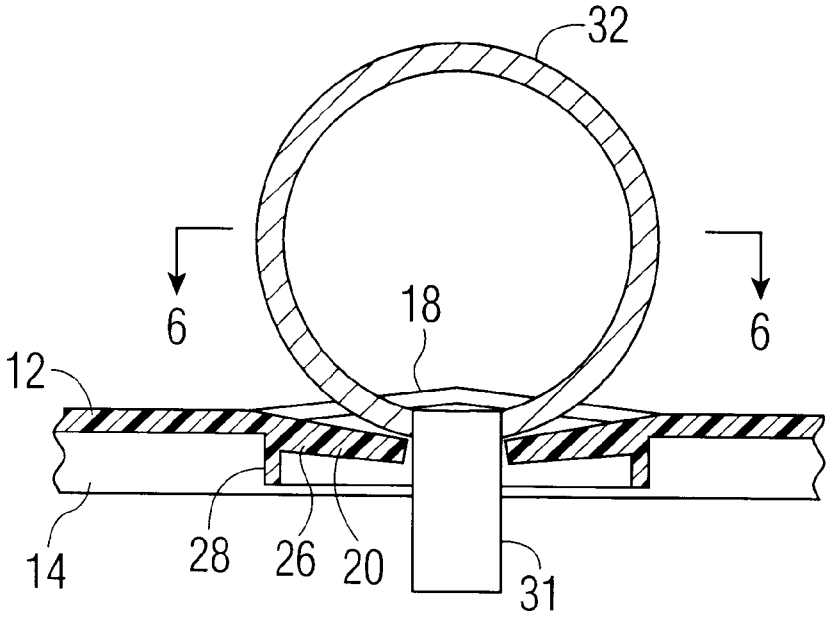
FIG. 5 is a cross-sectional view similar to FIG. 4, of one holding device of the ring pad of FIG. 1, with a ring positively held therein.
Figure 6:
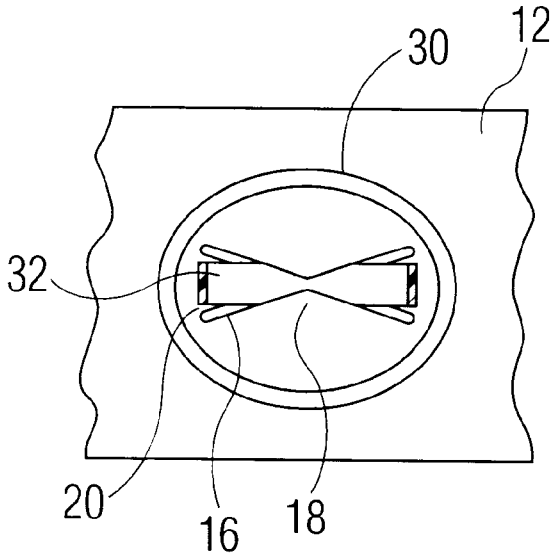
FIG. 6 is a cross-sectional view of the holding device of FIG. 5, taken along line 6—6 thereof.
Figure 7:
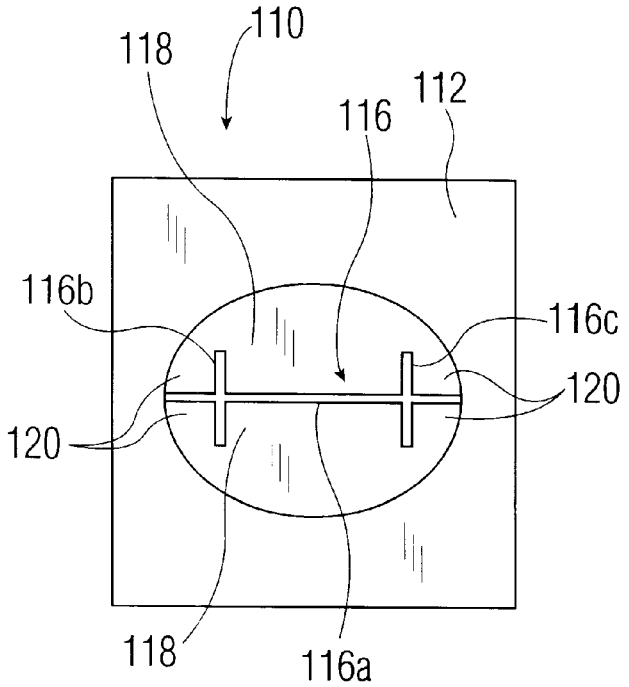
FIG. 7 is a perspective view of a ring pad according to another embodiment of the present invention.
Figure 8:
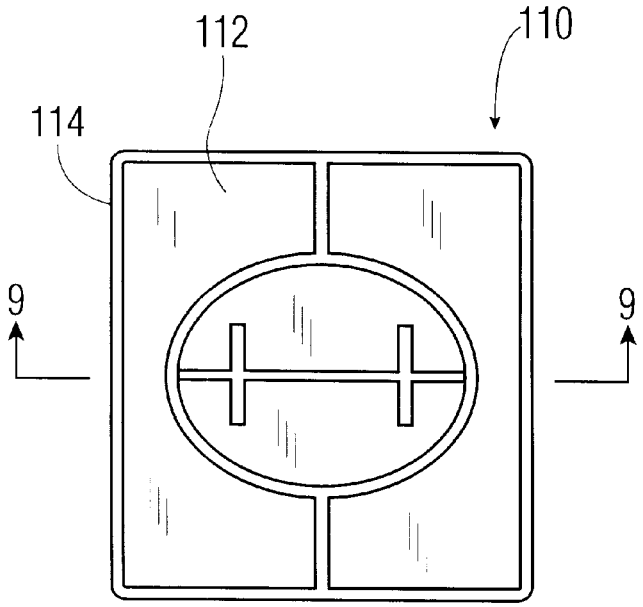
FIG. 8 is a bottom plan view of the ring tray of FIG. 7.

Also, a lower support wall 28 is formed at the underside of top wall 12 in surrounding relation to each slot 16. Lower support wall 28 can extend down the same distance as side wall 14, or can be spaced slightly upwardly therefrom. Lower support wall 28 can take any suitable form, such as oval, rectangular, etc., as shown in FIG. 2.

Also, for additional strength and/or decorative purposes, an upper lip 30 can be formed on the upper surface of top wall 12 in surrounding relation to slot 16. Upper lip 30 preferably takes the same shape as lower support wall 28, although the present invention is not limited thereby.

A ring 32 can be positioned on ring pad 10 and held thereby in two different ways.

In a first manner, the tag 31 attached to ring 32 is pushed through slot 16, and in this regard, ring 32 can be aligned with any of the legs of X-shaped slot 16. Then, with the tag extending to the bottom of ring tray 10, ring 32 is positioned over the center of X-shaped slot 16 such that ring 32 is in alignment with reinforcing walls 26. Then, ring 32 is pressed down. In such case, because of the flexible and resilient nature of ring pad 10, upper wall 12 will be bent slightly downwardly. A continued downward force on ring 32 forces hold-down flaps 18 and spring flaps 20 downwardly also. However, because flaps 18 are aligned with the opening in the ring, hold-down flaps 18 will spring back to their original position, and thereby be positioned above and within ring 32. As a result, ring 32 is held between hold-down flaps 18 and spring flaps 20. Because of the resilient nature of spring flaps 20, particularly, with the reinforcing walls 26, spring flaps 20 push ring 32 upward against the lower surfaces of hold-down flaps 18, thereby positively holding ring 32 in an upright position between hold-down flaps 18 and spring flaps 20.

To remove ring 32, it is only necessary to pull ring 32 upwardly, whereby hold-down flaps 18 will deform upwardly, thereby releasing ring 32. Hold-down flaps 18 will then return to their original, unbiased position.

With larger width rings 32, it may be more difficult to insert the ring 32 into the slot 16 in the above manner. In such case, after the tag is pushed through X-shaped slot 16, one edge of the ring 32 can be slid under one hold-down flap 18 and above spring flaps 20. Then, the other edge of the ring 32 is pushed down onto the other hold-down flap 18. This causes the other hold-down flap 18 to spring back to its original position, and thereby be positioned above and within ring 32. As a result, ring 32 is held between holddown flaps 18 and spring flaps 20. Because of the resilient nature of spring flaps 20, particularly, with the reinforcing walls 26, spring flaps 20 push ring 32 upward against the lower surfaces of hold-down flaps 18, thereby positively holding ring 32 in an upright position between hold-down flaps 18 and spring flaps 20.

To remove ring 32, it is only necessary to angle ring 32 to one side, thereby releasing it from one hold-down flap 18, and then pulling the ring 32 upwardly, whereby the other hold-down flap 18 will deform upwardly, thereby releasing ring 32. Hold-down flaps 18 will then return to their original, unbiased position.

Thus, the present invention displays substantially the entire ring in an upright position, with a simple structure, while concealing the tag at the same time.

Further, although slot 16 is shown with linear legs, slot 16 can have curved leg portions.

Referring now to FIGS. 7–10, a ring pad 110 according to another embodiment of the present invention will now be described in which elements corresponding to ring tray 10 are denoted by the same numerals, but augmented by 100.

Ring pad 110 includes a rectangular top wall 112 and a peripheral side wall 114 connected at the periphery of top wall 112 and extending down therefrom. The lower edge of side wall 114 is used for supporting jewelry pad on a surface or in a jewelry tray (not shown), as is well-known, for example, from U.S. Pat. No. 4,432,456.

Preferably, each pad 110 is made from a flexible and resilient plastic material that can be deformed but which retains its shape when the deformation force is removed. Alternatively, pad 110 can be made of a rubber or any other suitable material. In any event, pad 110 is made of a high memory material with a substantially thin, constant thickness throughout. Because pad 110 has a substantially constant thickness throughout, it is thin and therefore easily deformable, while reducing the amount of material that is used.

Thus, each pad 110 is formed as a single, unitary plastic molded part, although it is also possible to provide a fabric material or flocked layer thereon.

In accordance with the present invention, jewelry pad 110 is formed with at least one cut or slot 116 formed by a linear elongated slot portion 116*a*, and two parallel, spaced apart transverse slot portions 116*b* and 116*c*, which intersect elongated slot portion 116*a* at right angles about one-fifth of the length of slot portion 116*a*, measured from the ends thereof, such that elongated slot portion 116*a* bisects transverse slot portions 116*b* and 116*c*. It will be appreciated, however, that the shape of slot 116 can take any other suitable form, and is not limited to the shape and dimensions shown. Further, although one slot 116 is shown, the present invention is not limited to this number, and more than one such slot 116 can be provided.

As a result, each slot 116 forms two opposing rectangular hold-down flaps 118 defined between elongated slot portion 116*a* and transverse slot portions 116*b* and 116*c*. Each slot 116 also forms spring or retainer flaps 120 to the outside of transverse slot portions 116*b* and 116*c*.

Figure 9:
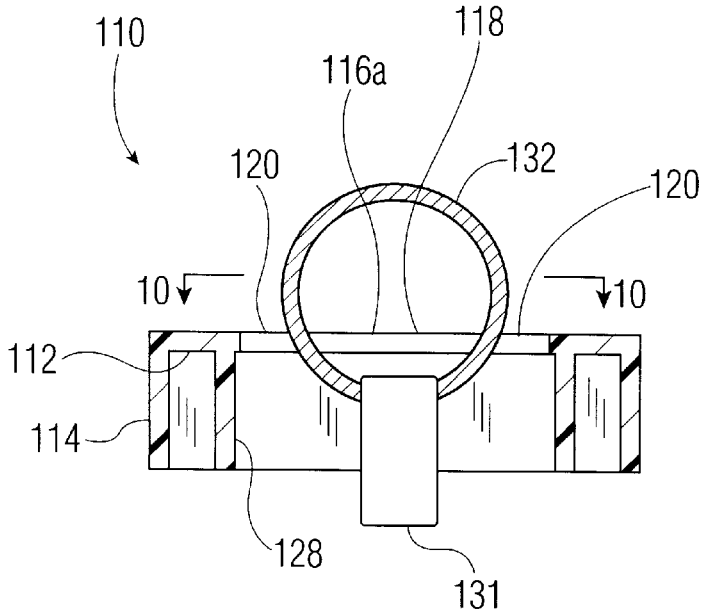
FIG. 9 is a cross-sectional view of the ring tray of FIG. 8, taken along line 9—9 thereof.
Figure 10:
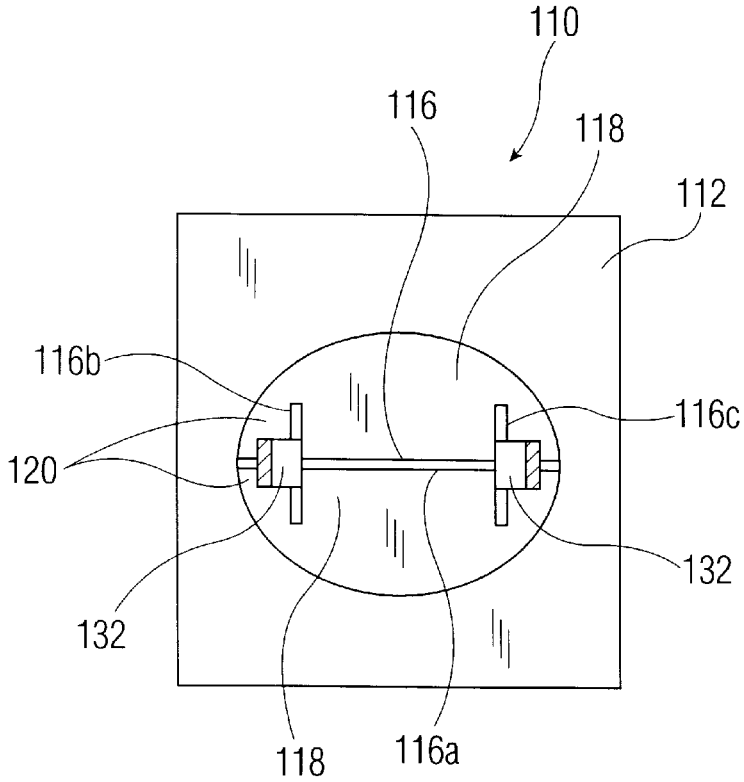
FIG. 10 is a cross-sectional view of the ring tray of FIG. 9, taken along line 10—10 thereof.

Further, a lower support wall 128, as shown in FIG. 9, is formed at the underside of top wall 112 in surrounding relation to each slot 116. Lower support wall 128 can extend down the same distance as side wall 114, or can be spaced slightly upwardly therefrom. Lower support wall 128 can take any suitable form, such as oval, rectangular, etc. In addition, the portion of top wall 112 in an area defined between lower support wall 128 can be flat, raised, concave or convex shaped.

In order to insert a ring 132 into ring pad 110, the tag 131 attached to ring 132 is pushed through slot 116, and in this regard, ring 32 can be aligned with elongated slot portion 116*a*. Then, with the tag extending to the bottom of ring tray 110, ring 132 is positioned over and in alignment with elongated slot portion 116*a* of slot 116 and is pressed down. In such case, because of the flexible and resilient nature of ring pad 110, hold-down flaps 118 will be bent slightly downwardly. A continued downward force on ring 132 forces hold-down flaps 118 and retainer or spring flaps 120 downwardly also. When ring 132 is pushed down past hold-down flaps 118, hold-down flaps 118 will spring back to their original position, and thereby be positioned above and within ring 132. As a result, ring 132 is held between hold-down flaps 118 which extend within ring 132, and spring or retainer flaps 120 which are positioned to the outside of ring 132. Because of the resilient nature of spring or retainer flaps 120, spring or retainer flaps 120 retain ring 132 against the lower surfaces of hold-down flaps 118, thereby positively holding ring 132 in an upright position between hold-down flaps 118 and spring or retainer flaps 120.

To remove ring 132, it is only necessary to pull ring 132 upwardly, whereby hold-down flaps 118 will deform upwardly, thereby releasing ring 132. Hold-down flaps 118 will then return to their original, unbiased position.

With larger width rings 132, it may be more difficult to insert the ring 132 into the slot 116 in the above manner. In such case, after the tag is inserted through elongated slot portion 116*a*, one edge of the ring 132 can be slid under one hold-down flap 118 and within transverse slot portions 116*b* and 116*c*, above spring or retainer flaps 120. Then, the other edge of the ring 132 is pushed down onto the other hold-down flap 118. This causes the other hold-down flap 118 to spring back to its original position, and thereby be positioned above and within ring 132. As a result, ring 132 is held between hold-down flaps 118 and spring or retainer flaps 120. Because of the resilient nature of spring or retainer flaps 120, spring or retainer flaps 120 retain ring 132 against the lower surfaces of hold-down flaps 118, thereby positively holding ring 132 in an upright position between hold-down flaps 118 and spring or retainer flaps 120.

To remove ring 132, it is only necessary to angle ring 132 to one side, thereby releasing it from one hold-down flap 118, and then pulling the ring 132 upwardly, whereby the other hold-down flap 118 will deform upwardly, thereby releasing ring 132. Hold-down flaps 118 will then return to their original, unbiased position.

It will therefore be appreciated that ring pads 10 and 110 do not require additional elements, such as ring posts or fingers, extending above the upper surface of the ring pad, and do not require a plurality of different layers of different materials. Further, the rings are positively held to ring pads 10 and 110 by hold-down flaps 18, 118 and spring or retainer flaps 20, 120, and cannot inadvertently escape therefrom. Also, any tags attached to the rings are easily inserted through slots 16, 116 and hidden at the bottom of ring tray 10.

It will be appreciated that various modifications can be made to the present invention. Thus, the height of side walls 14 and 114 can be varied, depending upon the size of rings to be held and the amount of flexion of hold-down flaps 18, 118 and spring or retainer flaps 20, 120. Alternatively, side walls 14 and 114 can be eliminated, as long as top wall 12, 112 is held in a jewelry tray with sufficient distance above a surface to permit flexion of hold-down flaps 18, 118 and spring or retainer flaps 20, 120.

As discussed above, the various shapes and dimensions of slots 16, 116 can be varied. For example, transverse slot portions 116*b* and 116*c* can be formed to extend from one side only of elongated slot portion 116*a*, whereby only one hold-down flap 118 would be formed. In the same manner, one of the four legs of X-shaped slot 16 could be eliminated, whereby only one hold-down flap 18 and one spring or retainer flap 20 would be formed. In such case, the slot would be in the form of an elongated slot portion having a single transverse slot portion extending at an acute angle from one side thereof.

Further, while reference has been made to a slot 16, 116 in top wall 12, 112, it will be appreciated that slot 16, 116 can be replaced by a slit therein of the same shape and dimensions, due to the flexibility and resilience of ring pads 10, 110. Therefore, reference to a slot in the claims herein is intended to include a slit as well.

Slots 16, 116 can be die cut slots or formed in the molding operation of pads 10, 110.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A ring pad comprising:

a top wall made from an elastic and resilient material; and a slot in said top wall, said slot being shaped to define a first hold-down flap in said top wall on one side of said slot and an adjacent first retainer flap in said top wall on an opposite side of said slot, such that a ring can be releasably captured between said hold-down flap and said retainer flap, with said hold-down flap positioned within said ring and said retainer flap positioned outside of said ring.

2. A ring pad according to claim 1, further comprising a side wall for supporting said top wall above a surface.

3. A ring pad according to claim 1, further including a lower support wall connected with an underside of said top wall and in surrounding relation to said slot.

4. A ring pad according to claim 1, wherein said slot includes an elongated slot portion having opposite ends, and a transverse slot portion extending at an angle from at least one side of said elongated slot portion at a position between the opposite ends of said elongated slot portion.

5. A ring pad according to claim 4, wherein said angle is an acute angle.

6. A ring pad according to claim 4, wherein said angle is a right angle.

7. A ring pad comprising:

a top wall made from an elastic and resilient material; and a slot in said top wall, said slot being shaped to define first and second opposing hold-down flaps in said top wall on opposite sides of said slot and adjacent first and second retainer flaps in said top wall on further opposite sides of said slot, such that a ring can be releasably captured between said hold-down flaps and said retainer flaps, with said hold-down flaps positioned within said ring and said retainer flaps positioned outside of said ring.

8. A ring pad according to claim 7, wherein said slot has a shape of an X.

9. A ring pad according to claim 8, wherein said X-shaped slot has intersecting leg portions that meet at a center, and said hold-down flaps form an obtuse angle at said center and said retainer flaps form an acute angle at said center.

10. A ring pad according to claim 9, further comprising a reinforcing wall at an underside of each retainer flap for increasing a spring action thereof.

11. A ring pad according to claim 7, wherein said slot includes a linear elongated slot portion and two spaced apart transverse slot portions which intersect said elongated slot portion.

12. A ring pad according to claim 11, wherein said transverse slot portions intersect said elongated slot portion at right angles.

13. A ring pad according to claim 11, wherein said elongated slot portion substantially bisects said transverse slot portions.

14. A ring pad according to claim 13, wherein said hold-down flaps are defined between said elongated slot portion and said transverse slot portions, and on opposite sides of said elongated slot portion, and said retainer flaps are 5 formed to the outside of said transverse slot portions.

15. A ring pad according to claim 7, further comprising a side wall for supporting said top wall above a surface.

16. A ring pad according to claim 7, further including a lower support wall connected with an underside of said top wall and in surrounding relation to said slot.

* * * * *